US008079397B2

(12) United States Patent
Robertson

(10) Patent No.: US 8,079,397 B2
(45) Date of Patent: Dec. 20, 2011

(54) ROMAN SHADE WITH PROTECTED OPERATING CORDS

(76) Inventor: Richard W. Robertson, Denver, CO (US)

( * ) Notice: Subject to any disclaimer, the term of this patent is extended or adjusted under 35 U.S.C. 154(b) by 236 days.

(21) Appl. No.: 12/610,125

(22) Filed: Oct. 30, 2009

(65) Prior Publication Data

US 2011/0100562 A1 May 5, 2011

(51) Int. Cl.
*A47H 5/00* (2006.01)

(52) U.S. Cl. ..... 160/84.05; 160/84.01; 160/84.04; 160/87

(58) Field of Classification Search ..... 160/84.01, 160/84.03, 84.04, 84.05, 168.1 R, 87, 89
See application file for complete search history.

(56) References Cited

U.S. PATENT DOCUMENTS

| | | | | |
|---|---|---|---|---|
| 1,752,610 | A | 4/1930 | McSpadden | |
| 2,254,820 | A * | 9/1941 | Donner | 160/84.04 |
| 2,865,446 | A | 12/1958 | Cole | |
| 3,777,800 | A | 12/1973 | Susoev | |
| 3,946,788 | A * | 3/1976 | Van Muyen | 160/84.04 |
| 4,069,857 | A | 1/1978 | Brookshire | |
| 4,813,468 | A | 3/1989 | Fraser | |
| 4,974,656 | A * | 12/1990 | Judkins | 160/84.04 |
| 5,090,098 | A | 2/1992 | Seveik et al. | |
| 5,123,473 | A | 6/1992 | Henkenjohann | |
| 5,129,440 | A | 7/1992 | Colson | |
| 5,273,097 | A * | 12/1993 | Siegler | 160/84.01 |
| 5,355,928 | A | 10/1994 | Robertson | |
| 5,419,385 | A | 5/1995 | Vogel et al. | |
| 5,445,204 | A * | 8/1995 | van der Wielen | 160/84.04 |
| 5,547,006 | A | 8/1996 | Auger | |
| 5,787,951 | A | 8/1998 | Tonomura et al. | |
| 6,302,982 | B1 | 10/2001 | Corey et al. | |
| 6,354,353 | B1 | 3/2002 | Green et al. | |
| 6,427,409 | B2 * | 8/2002 | Colson et al. | 52/506.08 |
| 6,484,786 | B1 | 11/2002 | Ruggles et al. | |
| D468,950 | S | 1/2003 | Judkins | |
| 6,662,845 | B1 | 12/2003 | Palmer | |
| 6,792,994 | B2 | 9/2004 | Lin | |
| D497,276 | S | 10/2004 | Tyner | |
| 6,938,664 | B2 | 9/2005 | Hsu | |
| 6,988,526 | B2 | 1/2006 | Judkins | |
| 6,989,066 | B2 | 1/2006 | Yu | |
| 2004/0065416 | A1 | 4/2004 | Auger et al. | |
| 2008/0173409 | A1 * | 7/2008 | Robertson et al. | 160/84.01 |

FOREIGN PATENT DOCUMENTS

| | | |
|---|---|---|
| DE | 674059 | 4/1939 |
| DE | 2441178 | 4/1975 |
| GB | 543937 | 3/1942 |
| JP | 02-197684 | 8/1990 |

* cited by examiner

*Primary Examiner* — Blair M. Johnson
(74) *Attorney, Agent, or Firm* — Sheridan Ross, P.C.

(57) ABSTRACT

A window covering is provided with protected operating cords. Protective coverings are installed over the cords. The coverings are expandable to move with the window covering as it is raised and lowered. The protective coverings may include an accordion folded configuration, a cellular configuration, and protective coverings with a continuous slot that allows the covering to be installed in an existing window covering. The protective coverings do not interfere with operation of the window coverings.

10 Claims, 4 Drawing Sheets

Fig. 1
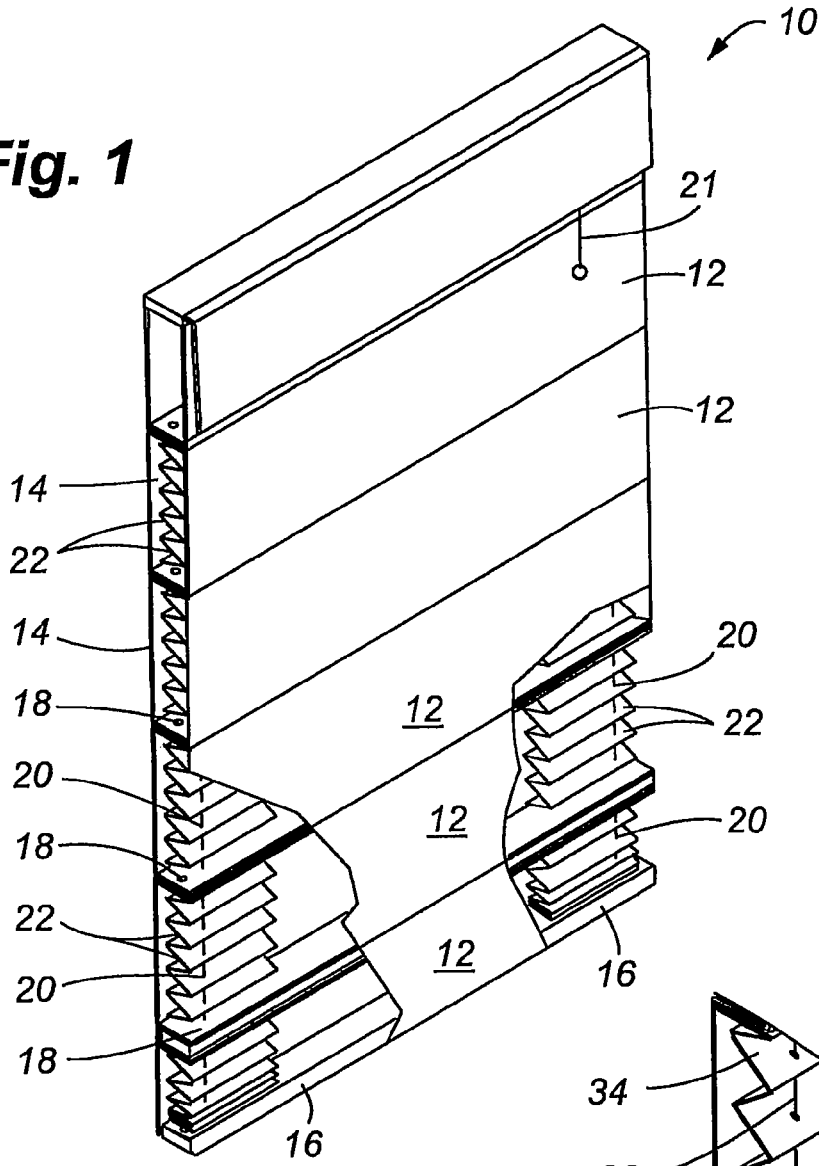
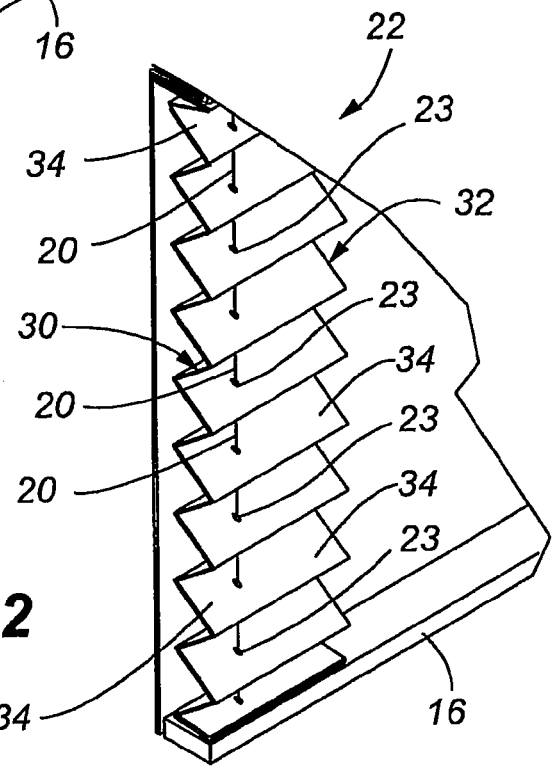
Fig. 2

ROMAN SHADE WITH PROTECTED OPERATING CORDS

FIELD OF THE INVENTION

This invention relates to window coverings such as Roman shades and blinds, and more particularly, to window coverings having a protective feature to cover the operating cords or drawstrings of the window covering that prevents access to the drawstrings/cords by a user, but still enables use of the drawstrings/cords for raising and lowering the window coverings.

BACKGROUND OF THE INVENTION

Most window coverings classified as shades or blinds have horizontally-oriented segments or panels spaced from one another along the length of the window covering. In the case of Roman shades, they may be progressively raised and lowered and when raised, the segments or panels overlap one another. The panels can be made from various materials to include plastic, metal or wood that maintains the linear horizontal orientation when the shade is raised and lowered.

It is also typical to control the opening and closing of a window covering by the use of operating cords or drawstrings, in which the string or cords are exposed to allow a user to easily grasp the cords and to allow the strings or cords to operate without interference.

One safety concern with window coverings is the presence of the exposed cords which pose a hazard for children. Unfortunately many children have been seriously injured or have died from strangulation caused by a child becoming entangled within the operating cords of the window covering. Over time, certain safety standards have been developed to help prevent such occurrences.

One solution for providing safety for exposed pull cords on a window covering such as drapes has been the use of a cord tension pulley in which the exposed operating cords must be mounted to a fixed station such as the adjacent wall. The cords must maintain a specified tension in the cord tension pulley, or the pull cords cannot operate the window covering. Although a cord tension pulley may provide increased safety for pull cords, there are still a number of operating cords that are disposed within the window covering and that can pose a hazard for children.

Therefore, it is one object of the present invention to provide a protective covering over the cords which prevents a child from wrapping the cord around the child's body, and otherwise prevents the cord from being separated in any manner that would allow the cord to pose a hazard. Furthermore, it is an object of the present invention to adopt the protective covering over the operating cords in a manner that does not interfere with smooth operation of the cords and further, provides this protective feature without substantially increasing the complexity of the window covering. It is yet another object of the invention to provide the safety feature in an economical solution, and one which does not detract from the aesthetic value of the window covering.

SUMMARY OF THE INVENTION

Therefore, in accordance with the present invention, a window covering is provided that incorporates protective coverings for the exposed operating cords of the window covering. The term "operating cord(s)" hereinafter is intended to define any cord, drawstring or other elongate flexible member that is used to control the position of the window covering or to change the orientation of the window covering. In one aspect of the invention, an improved window covering is provided. In another aspect of the invention, a protective covering is provided that can be used to modify an existing window covering. In another aspect, the invention includes a method of improving the safety of operation of a window covering.

In one embodiment of the present invention, the protective covering includes a length of an accordion folded material which extends along the length of the operating cord to be covered. The operating cord passes through aligned openings in the accordion folded material. There are two or more sets of operating cords located on opposite lateral sides of the window covering. Accordingly, the present invention provides protective coverings that cover each of the cords. The protective coverings can be one continuous covering that has a width extending along the entire width of the window covering, or the protective coverings can be individual coverings that cover the cords and the coverings therefore have a relatively small width. Because of the accordion folded configuration of coverings, the window covering may be easily raised or lowered without interference. The width of the protective coverings may vary, but in any event, it has been found that a width of six inches wide provides an adequate covering such that even if the entire cord and covering combination are displaced, the material of the covering cannot be wrapped in a manner that could cause entanglement. The protective covering material prevents any appreciable length of the cord from becoming exposed. The protective coverings also help to prevent the cords from becoming displaced from their vertical orientation and therefore, further prevents the cord from becoming any hazard.

Many Roman shades include a plurality of horizontally oriented and vertically spaced pleat assemblies that prohibit the use of one continuous protective covering. Accordingly, the covering of the invention may be segmented such that a plurality of protective covering elements extends between each adjacent plate assembly. The covering elements are aligned to substantially cover the entire length of the operating cord so there is no exposed section of the cords.

If the window covering has operating cords that extend in a continuous fashion along the length of the window covering and horizontal pleat assemblies are not used, the protective coverings in this case may be continuous lengths of material that also extend along the length of the window covering.

In another embodiment of the present invention, the protective coverings may be in the form of a cellular configured lining that will easily compress or expand depending upon the position of the window covering. The lining also has a plurality of aligned openings to receive a cord.

The window coverings may be manufactured with the protective coverings, or in another aspect of the present invention, an existing window covering may receive a protective covering in which the protective covering has a continuous slot or opening which is then fitted over the exposed operating cord. The upper or lowermost piece of material of the protective covering may have a tab or keeper that is mounted over the continuous slot, and holds the cord in the slot.

Further advantages and features of present invention will become apparent from a review of the following detailed description taken in conjunction with the drawings.

BRIEF DESCRIPTION OF THE DRAWINGS

FIG. 1 is a fragmentary perspective view of a Roman shade incorporating the protective features of the present invention;

FIG. 2 is an enlarged fragmentary perspective view of a portion of FIG. 1 illustrating details of a protective covering;

DETAILED DESCRIPTION

Figure 3:
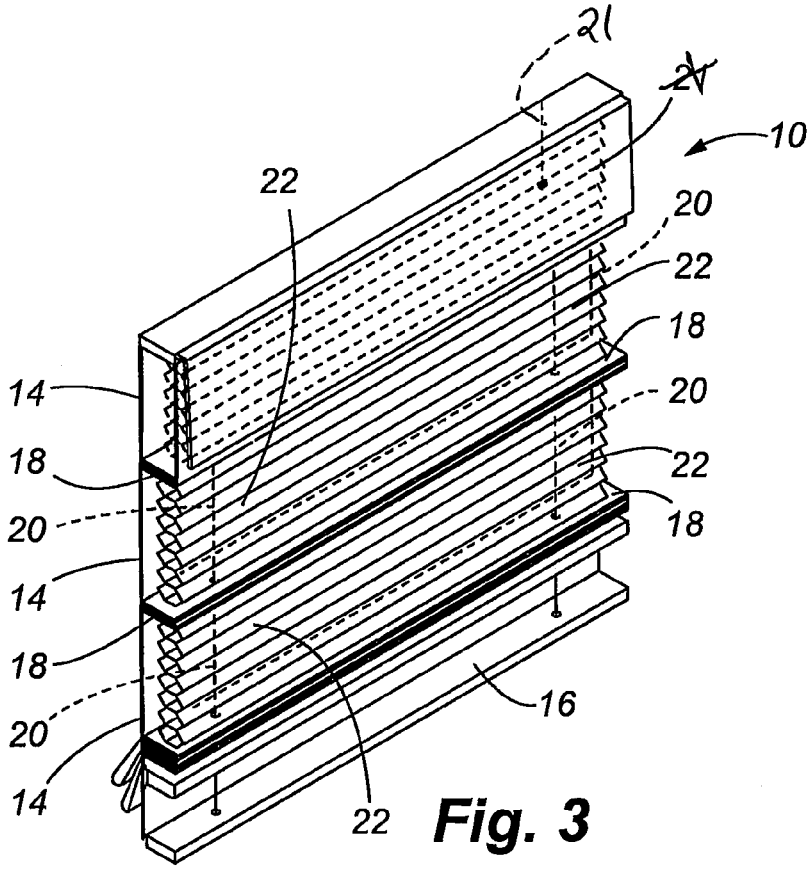
FIG. 3 is a perspective view of another type of Roman shade having only one panel, and wherein the protective feature is a single piece of material extending across the width of the window covering. This embodiment also uses a cellular lining configuration.

FIG. 1 is a fragmentary perspective view of a window covering 10 in the form of a Roman shade incorporating the protective covering features of the present invention. The window covering 10 is characterized by a plurality of front panels 12 and a corresponding plurality of rear panels 14. A number of pleat assemblies 18 are spaced along a length of the window covering. The pleat assemblies 18 include a horizontal stabilizing member and folded ends of the panel material from the adjacent upper and lower panels. The space bounded by adjacent pleats and front and rear panels define insulating cells. In the example FIG. 1, two operating cords are disposed at opposite lateral sides of the window covering, and the cords 20 extend the length of the window covering and terminate at a bottom rail 16. The operating cords communicate with a pull cord 21 that is grasped by the user to raise and lower the shade.

A pair of protective coverings 22 is installed over the cords 20 such that the coverings cover the entire the length of the cords. Referring to FIG. 2, the construction of a protective covering 22 is shown in which the covering is an accordion folded piece of material having an outer edge 30, an inner edge 32, and a plurality of folds 34. As also shown in FIG. 2, the cord extends through aligned openings 23 made in each folded piece of material. The protective covering therefore isolates the cord from exposure yet the covering enables smooth operation of the cord without interference. The protective cover easily expands and contracts to move with the positioning of the shade in either a more raised or lowered position. Even if the protective covering and cord are displaced from their normal vertical orientation, for example, if grabbed by a child, the protective covering prevents any appreciable length of cord from being exposed and therefore, the cord cannot be entangled with the child.

Referring to FIG. 3 another perspective view of a window covering is provided in which the window covering has but a single facing panel 14, thereby exposing the protective coverings 22. Further, the protective feature shown in this embodiment is a single piece of cellular lining material in which the cellular lining is also capable of expanding and collapsing as the window covering is raised and lowered. In this configuration, the protective covering extends across the width of the window covering. The cellular lining shown has a six-sided polygon shape and the lining is collapsible and expandable about the fold lines. Although the cellular lining has this six-sided shape, it shall be understood that the particular cellular lining may have other shapes in which folds allow the lining to expand and contract as the window covering is lowered and raised.

Figure 4:
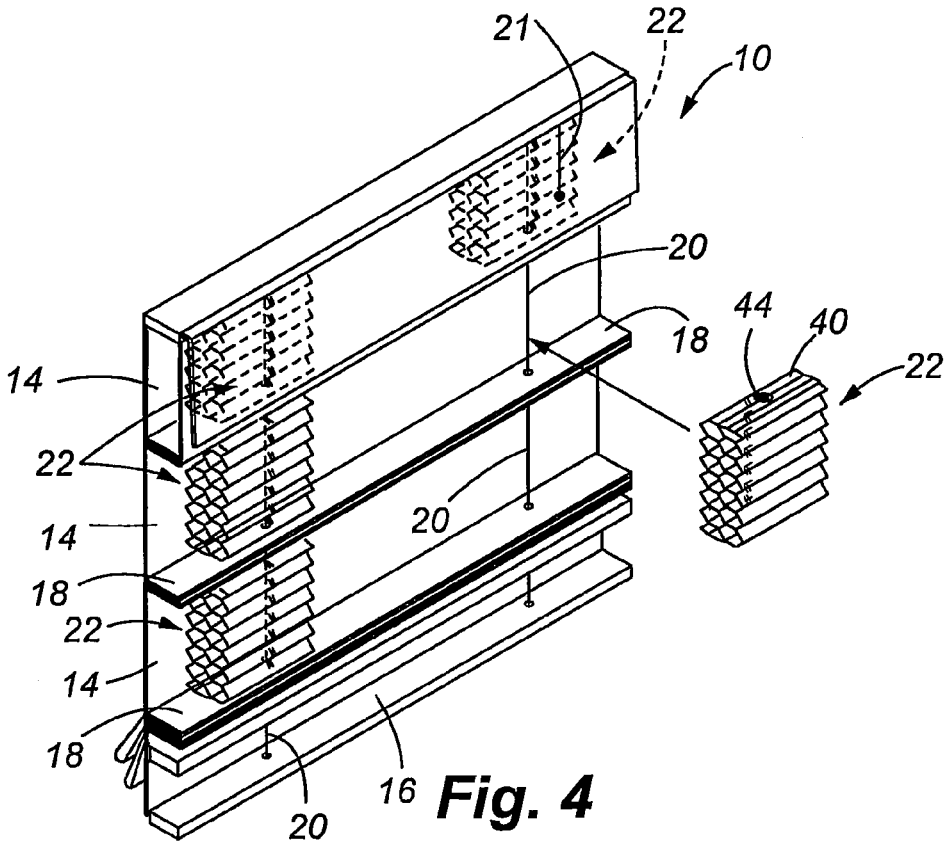
FIG. 4 is a perspective view of another embodiment of the present invention utilizing a cellular lining for the protective features, and further wherein the cellular lining is installed in a pre-existing window covering.
Figure 5:
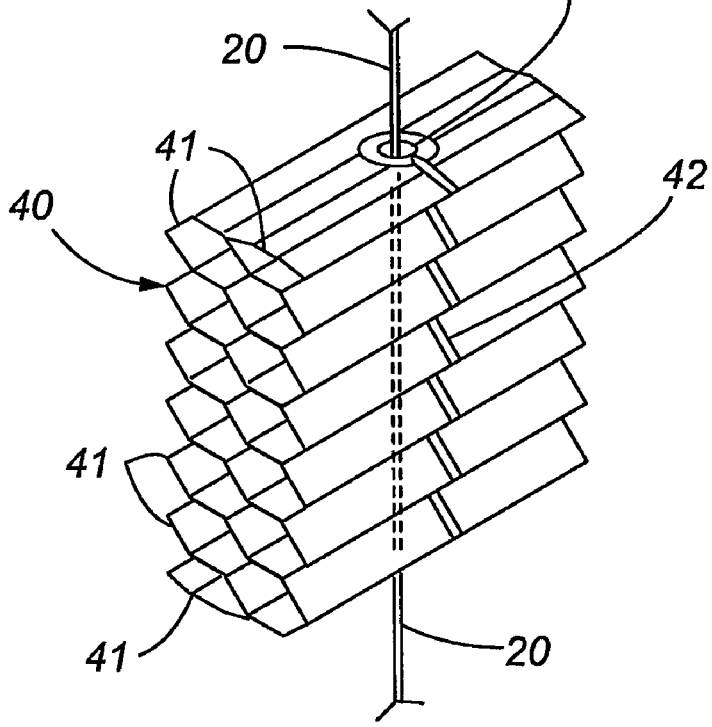
FIGS. 5 and 6 are greatly enlarged fragmentary perspective views of one of the cellular lining protective elements and showing in detail a tab used to hold the cord in the slot.
Figure 6:
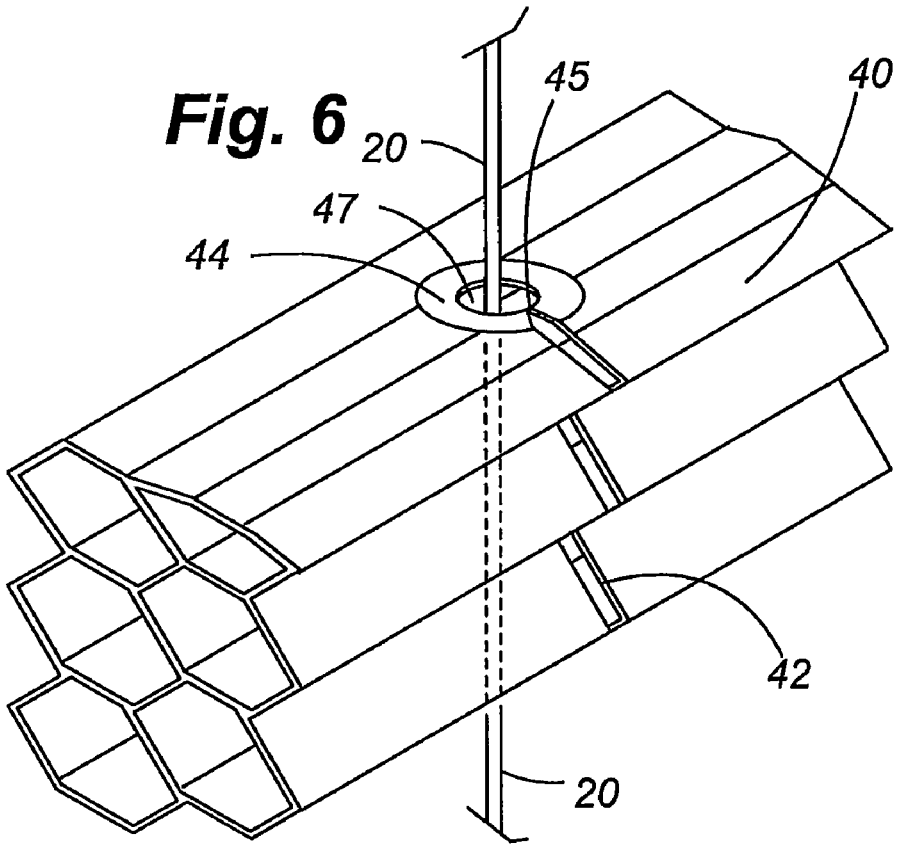

FIGS. 4-6 illustrate yet another preferred embodiment of the present invention in which the protective coverings 22 care in the form of a plurality of separated protective covering elements 40 that can be installed on existing window coverings. These protective elements 40 as shown are also made from a cellular construction and are collapsible and expandable to move with the window covering as it is raised and lowered. The construction of the cellular lining includes a plurality of side by side collapsible segments 41 that are stacked in a vertical direction to cover the cord. One side of each of the protective elements 40 has a continuous slot or channel 42 which receives the cord 20. Thus in order to install the element 40, the slot 42 is aligned with the cord 20 and the cord 20 is then captured within the slot 42. The slot 42 frictionally engages the cord to hold the covering element in place.

Referring to FIGS. 5 and 6, one or more tab keepers 44 may be used to better hold or lock the cord in the slot 42. The tab keepers 44 may be secured to the tubular elements 41 and aligned over the continuous slot 42. Each of the tab keepers 44 can be made from, for example, a plastic material. The tab keepers each have a very small slit 45 aligned with the continuous slot 42. The slit 45 is normally closed shut by contact between material located on both sides of the slit. The slit 45 can be forced open wide enough to receive the cord, but the slit then closes to capture the cord in the central opening 47 of the keeper. Each section of the cord which is to be covered may have a protective element installed as shown. Therefore, the present invention provides the ability to retrofit an existing window covering with selected protective elements in order to cover any exposed cords.

Figure 7:
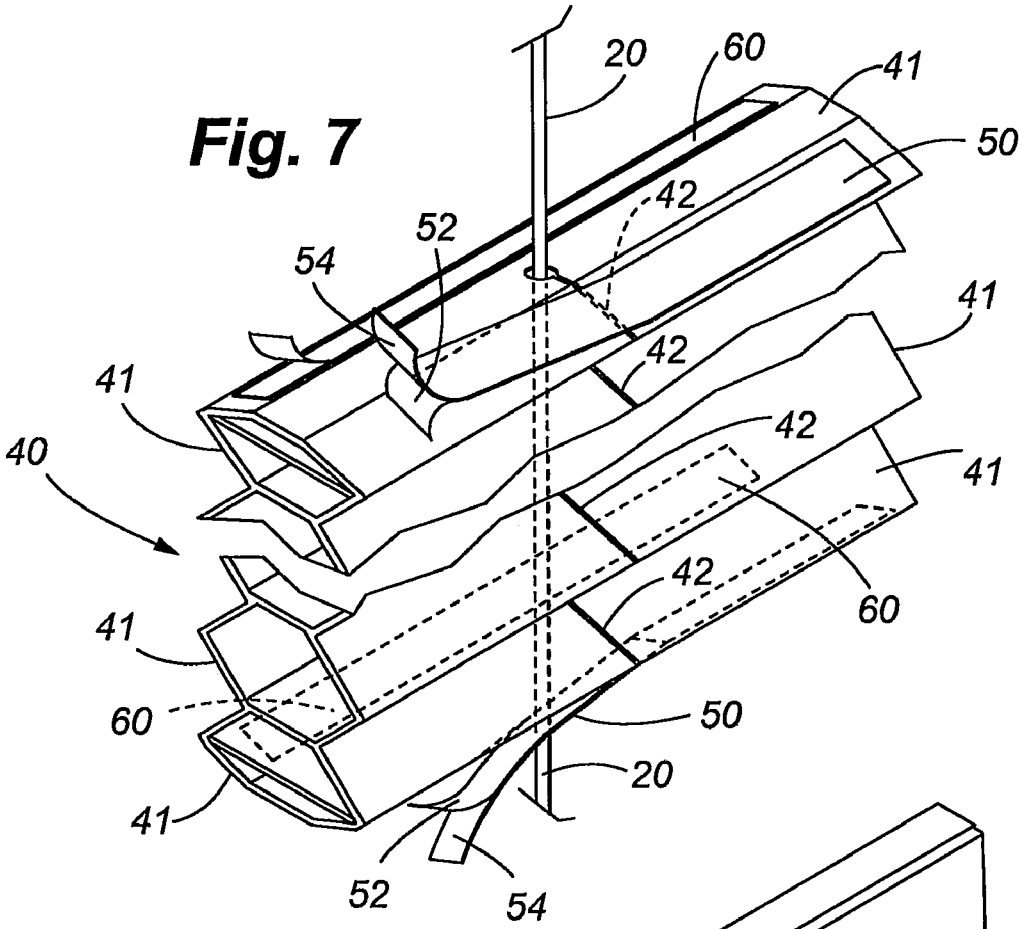
FIG. 7 is a greatly enlarged fragmentary perspective view of another embodiment of a protective element that uses an adhesive strip to hold the cord in the slot.

FIG. 7 illustrates another protective element 40 with a plurality of collapsible segments 41, and the continuous slot 42 that receives the cord 20. This embodiment has a single row or group of stacked segments 41 as shown. In lieu of tab keepers for holding the cord in the slots, a plurality of adhesive strips 50 is used. The strips 50 are positioned as shown to cover the slot 42. One half of a strip 50 is secured to a segment 41, and once the cord 20 is placed through the continuous slot 42, the other half of the strip 50 is attached to the segment thereby covering the slot 42. The strips have a non-adhesive layer 52 that can be removed to attach the remaining portion 54 of the strip 50 once the cord 20 is in place. Another set of adhesive strips 60 can be used to secure the protective element 40 to the adjacent rail or pleat of the window covering. Thus, one strip 60 can be attached to the most upper segment 41, and another strip 60 can be attached to the most lower segment 41.

Figure 8:
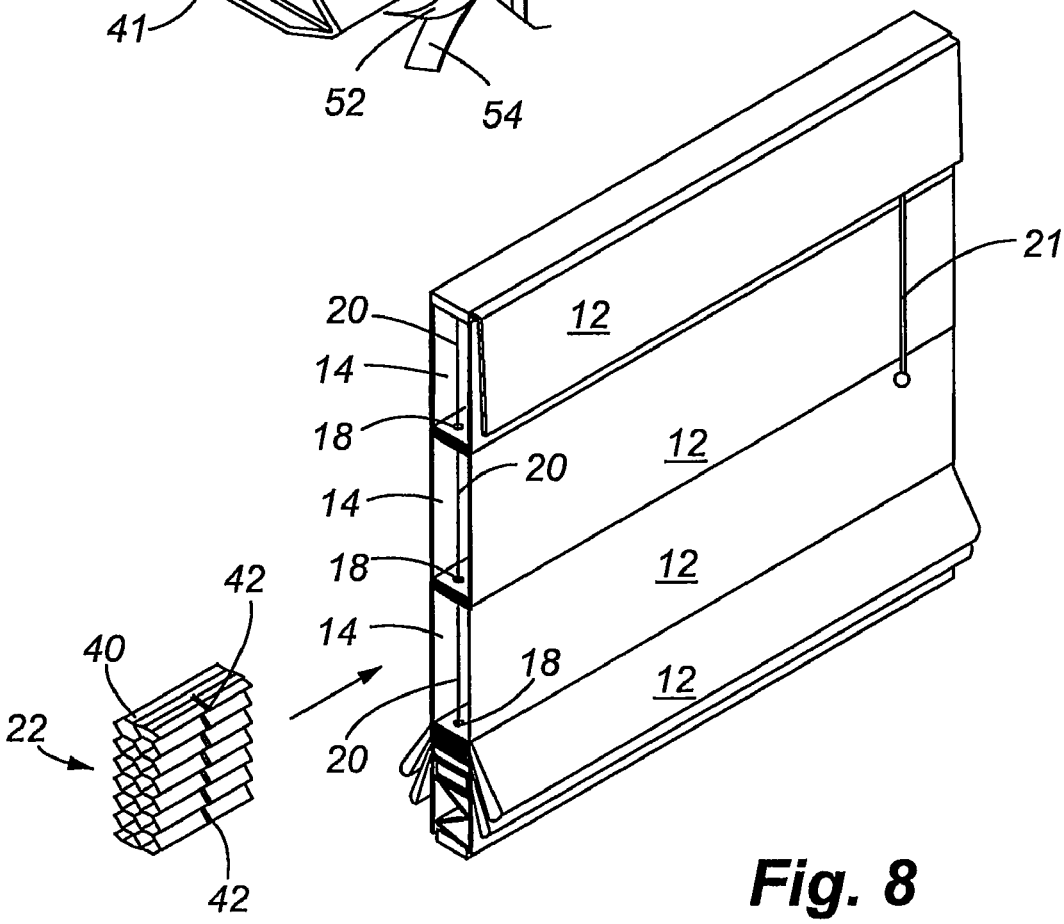
FIG. 8 is another perspective view of an existing window covering which receives the protective features in which the cellular lining is installed between front and rear facing panels of the window coverings.

FIG. 8 illustrates a window covering in which both front and rear facing panels are present such as FIG. 1, and therefore, the protective covering elements 40 must be inserted through the gap between the facing panel sections. Since the covering elements are compressible, they may be easily installed in the gaps so that the slots 42 can receive the cords 20.

Although the preferred embodiments illustrate use of the protective coverings that cover the entire exposed lengths of the operating cords, it is also contemplated that the protective coverings can be placed only in the locations where it is possible for a child to contact the cords, such as at the bottom portion of the window covering. Also, it is contemplated that the protective coverings can be used in combination with other safety features, such as break-away cords. Further, it is contemplated that a window covering may have combinations of the different embodiments in order to best cover the operating cords.

Although a Roman shade has been illustrated, it shall be understood that the protective features of the invention are adapted to be used with any type of window covering with exposed lengths of operating cords.

The present invention provides a number of advantages. First, a window covering may incorporate the protective features with an unobtrusive set of coverings which effectively isolate the cords from contact. Even if the cords are removed from their stowed vertical positions, the coverings prevent exposure of any appreciable length of the cords and therefore the cords cannot be removed to wrap around or entangle a person.

Although the present invention has been set forth with respect to various preferred embodiments, it shall be understood that modifications can be made to the invention commensurate with the scope of the claims appended hereto, and therefore the scope of the claims shall not be considered expressly limited to only the preferred embodiments.

What is claimed is:

1. A window covering comprising:

a first panel of material;

at least one vertically extending cord for operation of said window covering, said cord extending substantially along a length of said panel;

a bottom rail connected to a lower end of said panel;

a protective covering placed over said cord, said protective covering comprising an accordion folded material, and a plurality of aligned openings extending through said covering for receiving said cord, and wherein said protective covering is collapsible to expand and contract as the window covering is raised and lowered; and a second facing panel of material thereby forming, with said first panel of material, a plurality of cells, and pleat assemblies separating said cells, wherein said protective covering includes a plurality of protective covering segments extending between each of said pleat assemblies.

2. A window covering as claimed in claim 1, wherein:

said cord includes a pair of cords, and said protective covering includes a pair of protective coverings for covering each of said cords.

3. A window covering comprising:

a first panel of material;

at least one vertically extending cord for operation of said window covering, said cord extension substantially along a length of said panel;

a bottom rail connected to a lower end of said panel;

a protective covering installed over said cord, said protective covering made of a cellular configuration, and having a plurality of aligned openings extending there through for receiving said cord; a second facing panel of material thereby forming, with said first panel of material, a plurality of cells, and pleat assemblies separating said cells, wherein said protective covering includes a plurality of protective covering segments extending between each of said pleat assemblies.

4. A window covering as claimed in claim 3, wherein:

said cord includes a pair of cords, and said protective covering includes a pair of protective coverings for covering each of said cords.

5. A window covering comprising:

a panel of material;

at least one vertically extending cord for operation of said window covering, said cord extending substantially along a length of said panel;

a bottom rail connected to a lower end of said panel;

a protective covering installed over said cord, said protective covering including a continuous slot formed on one side of said protective covering for receiving the cord and to frictionally hold said cord around the protective covering.

6. A window covering, as claimed in claim 5, further comprising:

a keeper element placed over said slot for holding said cord in said slot, said keeper element having means for maintaining the cord within the keeper and therefore aligned with said slot.

7. A method of providing increased safety for operation of window coverings to prevent access to exposed operating cords, said method comprising:

providing a panel of material;

providing at least one vertically extending cord for operation of said window covering, said cord extending substantially along a length of said panel;

providing a bottom rail connected to a lower end of said panel;

installing a protective covering over said cord, said protective covering comprising at least one of an accordion folded material or cellular material with a plurality of aligned openings extending through said covering for receiving said cord, and wherein said protective covering is collapsible to expand and contract as the window covering is raised and lowered.

8. A protective covering especially adapted for covering exposed operating cords of a window cover comprising:

a length of cellular material having a substantially uniform width and a plurality of aligned openings enabling a straight length of cord to pass through the openings; and a continuous slot communicating with the openings, said slot formed through one side of said material and extending linearly along the material.

9. A covering, as claimed in claim 8, further including:

a keeper element placed over one end of said material and over an aligned opening, said slot communicating with said keeper, said keeper being selected as one of either a tab or an adhesive strip.

10. A covering, as claimed in claim 8, further including:

an adhesive strip secured to said material and covering said slot to prevent said cord from being removed from said slot.

* * * * *